United States Patent [19]

Hollowell

[11] 4,164,210

[45] Aug. 14, 1979

[54] PULSE COMBUSTION SYSTEM FOR HEATING OF AIR

[75] Inventor: George T. Hollowell, Mayfields Heights, Ohio

[73] Assignee: Gas Research Institute, Chicago, Ill.

[21] Appl. No.: 828,996

[22] Filed: Aug. 30, 1977

[51] Int. Cl.[2] ..... F24H 3/08

[52] U.S. Cl. ..... 126/110 R; 126/116 R; 165/DIG. 2; 237/55

[58] Field of Search ..... 126/110 R, 110 B, 116 R, 126/99 R; 237/55; 165/DIG. 2; 431/1

[56] References Cited

U.S. PATENT DOCUMENTS

| | | | |
|---|---|---|---|
| 2,916,032 | 12/1959 | Kitchen | 126/116 R |
| 2,965,079 | 12/1960 | Collinson | 122/24 |
| 3,091,224 | 5/1963 | Rydberg | 122/24 |
| 3,267,985 | 8/1966 | Kitchen | 431/1 |
| 4,080,149 | 3/1978 | Wolfe | 431/1 |

*Primary Examiner*—William F. O'Dea

*Assistant Examiner*—William E. Tapolcai, Jr.

*Attorney, Agent, or Firm*—Howson and Howson

[57] ABSTRACT

A secondary heat exchanger is connected in the flow path of exhaust gases passing from the exhaust expansion chamber to the flue gas outlet of a pulse combustion system, so as to be heated by the hot exhaust gases flowing therein, and air to be heated is first passed over the exterior of the secondary heat exchanger and then over the exterior of the combustion chamber. The temperature at the outlet end of the secondary heat exchanger is below the condensation point of exhaust gases therein, and the temperature at the inlet end of the secondary heat exchanger is sufficiently low to permit use of a wider range of materials for the secondary heat exchanger. The secondary heat exchanger is made of a material of high thermal conductivity which is corrosion resistant, and increases the thermal efficiency of the system greatly while exerting a muffling action to reduce the noise in the system.

7 Claims, 5 Drawing Figures

PULSE COMBUSTION SYSTEM FOR HEATING OF AIR

BACKGROUND OF THE INVENTION

This invention relates to improvements in pulse combustion systems for heating air.

Pulse combustion heater systems have been known for many years. In such devices, a combustible fuel and combustion air are admitted into a pulse-combustion chamber where they are ignited to produce an internal explosion, with resultant generation of heat. Immediately after each such explosion, an accoustically-produced negative pressure in the chamber draws additional air and fule into the chamber through appropriate valves, whereupon the next explosion occurs and closes the valves until the next negative pressure occurs. Accordingly, once started, a self-perpetuating series of heat-releasing explosions are produced, with combustion air and fuel being sucked in automatically and intermittently through appropriate air and gas inlet valves as needed. In response to the combustion chamber pulses of high pressure, the hot exhaust gases from the combustion chamber are normally expelled forcefully through a tail pipe leading to an exhaust decoupling or expansion chamber, from which an exhaust-pipe line extends to an exhaust flue outlet.

In a typical system then, air from outside a building is drawn into the combustion chamber along with combustible gas to produce the desired pulse combustion therein, the exhaust gases resulting from this combustion then passing through the tail pipe, decoupling chamber, an exhaust-pipe line and a flue outlet to the exterior of the building; this flow occurs without requiring special fans or blowers, in response to the pumping action provided by the acoustically-resonant combustion chamber and tail pipe, in combination with combustion-air and fuel-gas inlet valves. Room air to be heated may be passed by forced draft over the exterior of the combustion chamber, the exhaust expansion chamber and at least part of the tail pipe, and then returned in heated condition to the room. The combustion chamber may in some cases be provided with external fins to enhance the heat exchanger operation. Normally it is also desirable, or necessary, to provide one or more mufflers in the exhaust pipe line to reduce the noise generated by the pulse combustion operation.

U.S. Pat. No. 2,916,032 of J. A. Kitchen, filed Oct. 10, 1957 and issued Dec. 8, 1959, shows one previously-known pulse combustion system for accomplishing the heating of room air. In the system of this patent, the pulse combustion chamber a is supplied with combustion air and fuel gas, the combustion chamber is provided with external heat transfer fins b, the hot exhaust gases from chamber a pass through an exhaust manifold c to a heat exchanger consisting of a plurality of tubes d in zig-zag form having heat transmitting metal plates e combined therewith, and the tubes and plates are arranged parallel with each other in a plane parallel with the direction of the flow of the air to be heated. The outlet ends of the heat exchanger tubes are connected to another gas manifold f, from which the exhaust gases are supplied to a compartment r serving as an exhaust gas cushion. The exhaust gases from compartment r are conveyed through a perforated pipe u to the atmosphere, this pipe serving as an exhaust gas muffler. The flow of the air to be heated is from beneath the exhaust manifold f, across the latter, then across the exterior surfaces of the heat exchanger, and finally across the exterior surfaces of the finned combustion chamber into the space to which the heated air is to be delivered.

While suitable for many purposes, systems such as that shown in the above-referenced patent generally require one or more special exhaust mufflers to minimize what would otherwise constitute very objectionably loud noise, caused by the explosions in the pulse combustion chamber. They are also subject to the problem that at least the inlet end of the heat exchanger operates at extremely high temperatures and must therefore consist of materials especially adapted for such high temperature operation, while its lower or outlet end operates at greatly reduced temperatures for which condensation of exhaust gases occurs, leading to the possibilities of metal corrosion near the outlet end of the heat exchanger. The heat exchanger in such a system is therefore such as to require, for best operation, use of materials which are not only satisfactory for extremely-high temperature operation, but are also of high thermal conductivity and resistant to corrosion by condensate formed in the lower temperature portions thereof. Ferrous metals have the necessary high-temperature stability, but have rather poor thermal conductivity and corrosion resistance; copper and aluminum, for example, on the other hand have excellent thermal conductivity and corrosion resistance but tend to soften at very high temperatures. Accordingly, in such a prior art system the simultaneous requirements of high thermal conductivity for best heat exchange, high-temperature stability in the face of the very high temperatures at the inlet of the secondary heat exchanger, and corrosion resistance near the outlet of the secondary heat exchanger produce problems with respect to the materials to be used in making the heat exchanger.

It is an object of the present invention to provide a new and useful pulse combustion system for the heating of air.

Another object is to provide such system which provides high thermal efficiency by providing a relatively large amount of heat-exchanger surface.

A further object is to provide such a system in which the need for special exhaust mufflers is greatly reduced or completely eliminated.

Still another object is to provide such a system in which the heat exchanger operates at relatively low maximum temperatures, whereby the materials used therein need only be compatible with requirements of corrosion resistance and high thermal conductivity, and are not also subject to the severe and often conflicting requirements of operation at very high temperatures.

It is also an object to provide such a system which is compact and relatively inexpensive to make and maintain.

SUMMARY OF THE INVENTION

According to the invention, a secondary heat exchanger is connected in series in the flow path of hot exhaust gases passing from the exhaust expansion chamber to the flue gas outlet, the secondary heat exchanger preferably comprising, for example, a plurality of finned heat-conductive pipes of corrosion-resistant materials of high thermal conductivity, through which the exhaust gases pass. The air to be heated is passed first over the surfaces of the secondary heat exchanger, then over the surfaces of the combustion chamber, and preferably also over the tail pipe and the exhaust decoupling chamber.

Since the secondary heat exchanger, and especially the inlet end thereof, is subjected to a flow of the relatively cool newly-admitted room air, it operates at relatively-low temperatures, typically of the order of less than 150° F. at its outlet, and less than 800° F. at its inlet, and therefore while it provides useful heating of the newly-admitted air it can be made of materials which are not required to withstand extremely high temperatures. It also serves as an effective noise muffler, generally making other special exhaust mufflers unnecessary, thereby avoiding the cost as well as the bulk typically required by special exhaust mufflers. The temperature in the secondary heat exchanger near its outlet is preferably low enough that condensation occurs therein, resulting in high thermal efficiency of heating of the room air.

BRIEF DESCRIPTION OF FIGURES

These and other objects and features of the invention will be more readily understood from a consideration of the following detailed description, taken in connection with the accompanying drawings, in which.

DESCRIPTION OF SPECIFIC EMBODIMENTS

Figure 1:
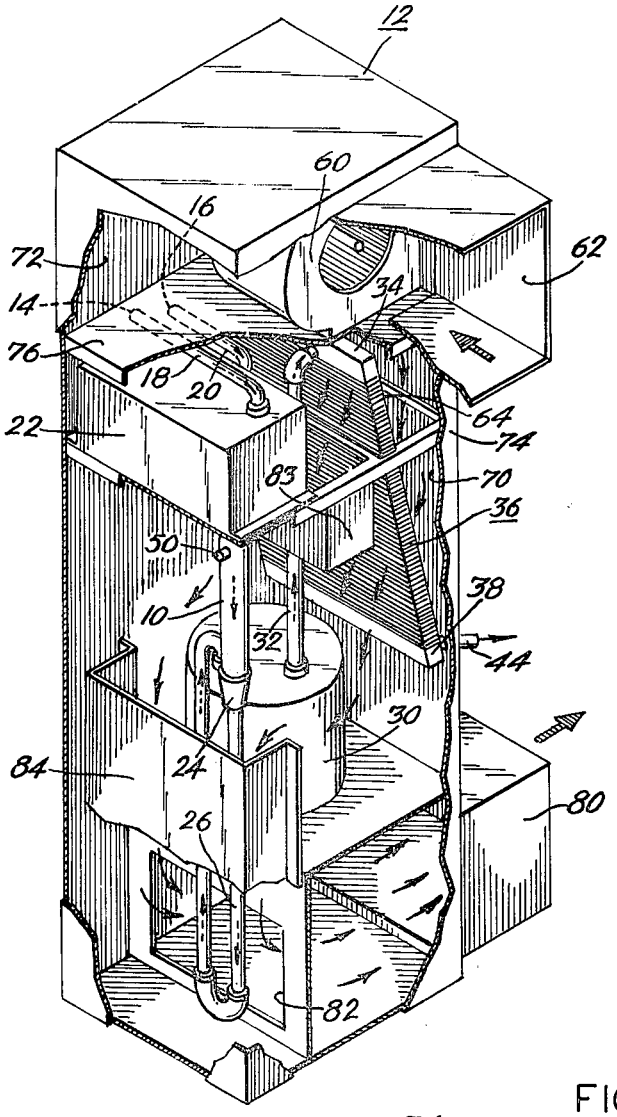
FIG. 1 is a perspective view, with portions broken away, of a pulse combustion system suitable for the heating of room air, embodying the present invention in one of its forms.
Figure 2:
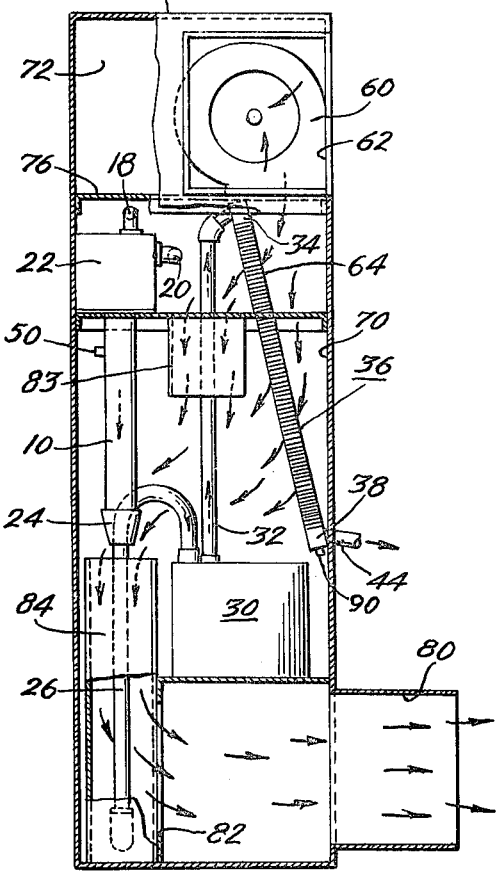
FIG. 2 is a side view of the embodiment of FIG. 1, with portions broken away.
Figure 3:
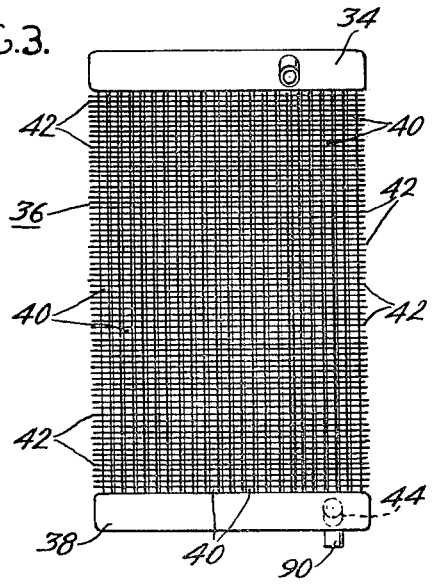
FIG. 3 is a face view of the secondary heat exchanger employed in the systems of FIGS. 1 and 2.
Figure 4:
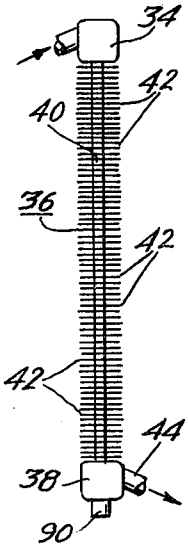
FIG. 4 is an end view of the heat exchanger of 3.
Figure 5:
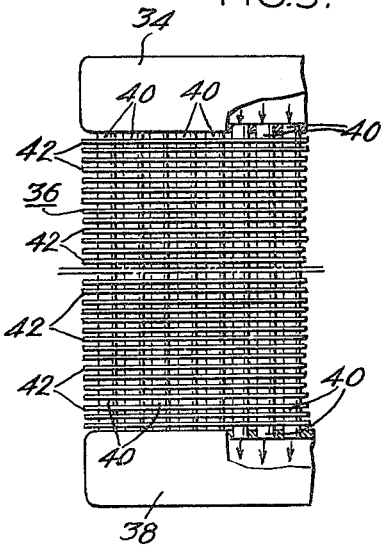
FIG. 5 is an enlarged fragmentary view of portions of the heat exchanger of FIG. 3, showing the construction thereof in more detail.

Referring now to the specific embodiment of the invention shown in the drawings by way of example only, a pulse combustion chamber 10 in the form of a relatively large diameter tube is mounted within a furnace housing 12, and supplied with fuel gas from fuel gas inlet 4 and with combustion air from combustion air inlet 16. The latter two inlets are connected by respective supply tubes 18 and 20 to an enclosure 22, which contains conventional fuel gas and air expansion chambers, gas and air flapper valves, and an auxiliary blower for use in initial start up, by means of which combustion air and fuel gas are supplied to the interior of pulse combustion 10. The details of these supply lines, the expansion chambers, the flapper valves and the auxiliary blower are not shown, in the interest of clarity, since they may be constructed in a variety of manners well known in the art and are not in themselves necessarily different from previously-known arrangements utilized for this purpose.

The downstream or exhaust end of pulse combustion chamber 10 is connected through a pipe reducer 24 to a tail pipe 26, the downstream or exhaust end of which leads into the top of an exhaust expansion chamber 30, sometimes known as a decoupling chamber. An exhaust pipe 32 leads from chamber 30 to the upper header 34 of a secondary heat exchanger 36.

The secondary heat exchanger 36 comprises the top header 34, a lower header 38 and a plurality of parallel, vertical, spaced-apart thermally-conductive pipes 40 each connected between the headers, together with an array of horizontally-extending thermally-conductive fins such as 42 each in contact with each of the pipes 40. The outlet 44 from the lower header 38 constitutes the flue outlet for the system, which may be connected to the exterior of the building, the room air of which is to be heated by the furnace here being described.

The portion of the system thus far described operates in the normal manner, with the exception of the function of the secondary heat exchanger. Thus, pulse combustion may be initiated in pulse combustion chamber 10 by means of an igniter 50, such as a spark plug, with the initial flow of combustion air and fuel gas into the chamber 10 provided by the initially-operated blower located within chamber 22 and the fuel gas suppled in response to the normal gas-line pressure; thereafter the burner operation is self-sustaining. The hot exhaust gases from the combustion chamber pass downstream through the tail pipe 26, the exhaust expansion chamber 30, the exhaust 32, the secondary heat exchanger 36 and the flue outlet 44 to the exterior.

At the same time, a main room-air blower 60 pulls in room air by way of conduit 62 and delivers it downwardly onto the outer face 64 of heat exchanger 36, the room air preferably initially flowing against the inlet end of the outer face of the heat exchanger as shown by the heavy room-air arrows in the drawings. The heat exchanger is positioned with its bottom and opposite sides in substantially air sealed relation to the interior housing walls 70, 72, and 74; the upper portion of secondary heat exchanger 36 is in substantial air sealing relation with a horizontal platform 76 positioned above it, on which main blower 60 may be mounted. Accordingly, the room air to be heated is constrained to flow through the openings between the pipes and fins in the secondary heat exchanger. The pulse combustion chamber 10, the tail pipe 26, the exhaust expansion chamber 30 and the exhaust pipe 32 are all positioned in the path of the room air flow, between the point at which it passes through the secondary heat exchanger 36 and the point at which it is delivered to the room-air discharge conduit 80, by way of conduit opening 82 near the bottom of the furnace housing 12. A U-shaped baffle 83 serves to divert a substantial part of the internal room air flow over the expansion chamber 30. A shield 84 mounted to the exterior walls of the furnace housing 12 assists in shielding the outer housing 12 from heat from the tail pipe 26.

It is noted that in this system there is no exhaust muffler other than the secondary heat exchanger 36, which provides this function in itself. It is also noted that the room air to be heated is constrained to pass first through the secondary heat exchanger 36 before it passes over the much hotter surfaces of combustion chamber 10, tail pipe 26 and expansion chamber 30. The secondary heat exchanger is thereby kept relatively cool, and in fact under preferred operating conditions is sufficiently cool to cause condensation of water in the exhaust gases within it, with the resultant recovery and transfer to the room air of the latent heat of vaporization of such gases. A condensate drain 90 is provided at the bottom of the secondary heat exchanger to permit continuous draining of such condensed fluid.

Since the secondary heat exchanger does operate at relatively low temperatures, it need not be made of special materials such as stainless steel, which are especially adapted for high temperature operation but unfortunately are of lower thermal conductivity than desired. Instead, it need merely meet the requirement of being stable at moderate temperatures and adequately corrosion-resistant in the presence of the condensate, and can therefore be of a corrosion-resistant material of high thermal conductivity, for example, the vertical tubes 40 and the headers 34 and 36 may be of copper, and the fins 42 may be of aluminum.

Without thereby in anyway limiting the scope of the invention, the following examples of specific parameters of one system, constructed in accordance with the invention and the foregoing drawings, may be as follows. The entire furnace unit may be approximately 18 ¼ inches wide, 21 ½ inches deep and about 58 inches high. The combustion chamber, tail pipe and exhaust pipe may be made from standard iron pipe fittings, the combustion chamber typically being an 8 inch length of 4 inch pipe; the combined length of combustion chamber and reducer 24 may be 12 inches. The tail pipe and exhaust pipe may each be of 1 ½ inch pipe; the length of the tail pipe 26, from the reducer 24 to the inlet to the exhaust expansion chamber 30, may be about 96 inches. The exhaust expansion chamber may be a cylinder 12 inches in diameter and 12 inches long. The exhaust pipe 32 may be an 18 inch length of 1 ¼ inch pipe. The secondary heat exchanger 36 may comprise 13 30-inch long vertical copper tubes and the flue outlet pipe 44 might be 1 inch ID copper tube.

In such a system, the temperature of the flue gas entering the secondary heat exchanger is typically about 600° to 650° F. Halfway down the secondary heat exchanger, the temperature is typically about 140° F. At the exit through the one-inch diameter flue outlet tube, the flue gas temperature is typically about 95°-100° F. With such an arrangement, overall thermal efficiencies of about 85-98% have been obtained with satisfactory combustion, the operating level of $CO_2$ being typically about 10.0-10.5%, with a less than 0.01% air-free CO, for an input of 100,000 B.T.U.H. of natural gas.

With such maximum temperatures of about 650° in the heat exchanger, copper materials and usual solders can be used in the secondary heat exchanger, providing convenience in construction, high thermal conductivity and good corrosion resistance to condensed gases. While the condensate is primarily water in the case of natural gas fuel, it also typically contains some sulfur compounds, traces of other materials, and a mild acidity, due to impurities in the fuel gas, and it is these substances other than water which can be corrosive to certain materials such as ferrous metals.

It is preferred that the maximum temperature of the exhaust gases in the copper secondary heat exchanger be limited to no higher than about 800° F.; in some cases it may be desirable to limit it to very low values, such as 500° F. The exact operating temperature can be adjusted in design as a function of the heat output of the burner and the volume rate of flow of room air over the secondary heat exchanger, for example. In this connection it is noted that conventional control means will normally be used to assure that the room air flow is always present at the secondary heat exchanger whenever the temperature of the exchanger would otherwise become too hot. For example, the room air blower may be controlled always to come on when the burner starts up, and to remain on after the burner stops for a time long enough to reduce the maxiumum temperature of the secondary heat exchanger to the desired level when the blower is turned off.

In a conventional arrangement in which the exhaust gases in the combustion chamber of a pulse combustion system have a maximum temperature of about 1,800° to 2,000° F., it will generally be ncessary to use a high-temperature resistant material such as ferrous metal for the heat exchanger; to reduce corrosive effects, stainless steel may be used. However, stainless steel and other ferrous metals will not provide the high thermal conductivity of copper, and the thermal efficiency of the system will therefore be reduced by the limited options available with respect to the material which can be used.

The above-mentioned condensation of water in the exhaust gases has been found to make it possible to increase the thermal efficiency to above about 89 or 90%; for example, while without condensation thermal efficiencies of up to about 80-89% can be achieved, about 95-98% efficiency can be obtained when condensation is caused to occur in the secondary heat exchanger. In the type of system described, condensation will generally first occur at a point in the secondary heat exchanger where the gas temperature has dropped to about 125°-150° F., and the outlet end portion of the secondary heat exchanger is preferably operated to produce gas temperatures below about 150° F. for this reason.

While the invention has been shown and described with particular reference with specific embodiments thereof, it will be understood that it may be embodied in a variety of forms diverse from those specifically shown and described, without departing from the spirit and scope of the invention as defined by the appended claims.

What is claimed is:

1. In an air-heating pulse combustion furnace system comprising a pulse combustion chamber, means for feeding combustion air and combustible gas into said chamber to form a combustible mixture, an exhaust expansion chamber connected to receive hot exhaust gases from the outlet of said combustion chamber, a tail pipe connected to said combustion chamber and supplying hot exhaust gases from said combustion chamber to said expansion chamber, a flue gas outlet, an exhaust pipe line connecting said expansion chamber to said flue gas outlet gas, means for igniting said combustible mixture to produce pulse combustion in said chamber, and means for directing a flow of air to be heated over the exterior surfaces of said combustion chamber to heat said air:

the improvement comprising a secondary heat exchanger connected in said exhaust pipe line between said expansion chamber and said flue gas outlet so as to be heated by said exhaust gases flowing therein; and means for directing the flow of said air to be heated over the exterior surfaces of said secondary heat exchanger prior to said flow thereof over the exterior surfaces of said combustion chamber.

2. The system of claim 1, wherein said secondary heat exchanger comprises an array of pipe lines having fins secured thereto, said exhaust gases flowing through said secondary heat exchanger pipe lines, said secondary heat-exchanger pipe lines being of a high thermal conductivity material.

3. The system of claim 2, wherein said tubes are of a material selected from the class consisting of copper, aluminum and highly thermally conductive alloys thereof.

4. The system of claim 1, wherein the temperature of said exhaust gases and the flow of said air to be heated is such that the temperature of said exhaust gases near the outlet end of said secondary heat exchanger is below the condensation point for at least some components of said exhaust gases, whereby condensate is formed in said secondary heat exchanger.

5. The system of claim 1, wherein the temperature of said exhaust gases at the inlet end of said secondary exchanger is no greater than about 800° F., and at the outlet end thereof is less than about 150° F.

6. The system of claim 1, wherein said gas is natural gas.

7. The system of claim 1, wherein said means for directing the flow of said air to be heated over the exterior of said secondary heat exchanger comprises blower means for creating said flow of said air to be heated, said secondary heat exchanger being positioned along the path of said flow nearer said blower means than is said pulse combustion chamber.

* * * * *